US008245634B1

(12) United States Patent
Maiaro et al.

(10) Patent No.: US 8,245,634 B1
(45) Date of Patent: Aug. 21, 2012

(54) PERFORATED SHEET MATERIAL AND A SET OF SEQUIN/CONFETTI

(76) Inventors: Richard J. Maiaro, Mount Vernon, NY (US); Kenneth Lauro, Mahopac, NY (US)

( * ) Notice: Subject to any disclaimer, the term of this patent is extended or adjusted under 35 U.S.C. 154(b) by 224 days.

(21) Appl. No.: 12/456,371

(22) Filed: Jun. 16, 2009

(51) Int. Cl.

| | |
|---|---|
| ***A47J 27/00*** | (2006.01) |
| ***A47J 37/00*** | (2006.01) |
| ***B32B 3/10*** | (2006.01) |
| ***B32B 3/24*** | (2006.01) |

(52) U.S. Cl. ..... 99/450; 99/444; 99/447; 428/137; 428/145; 428/179

(58) Field of Classification Search ..... 99/450, 99/400, 401, 447, 444, 446; 428/137, 145, 428/179

See application file for complete search history.

(56) References Cited

U.S. PATENT DOCUMENTS

| | | | | |
|---|---|---|---|---|
| 3,555,994 | A | 1/1971 | Nemetz et al. | |
| 4,394,410 | A * | 7/1983 | Osrow et al. | 428/43 |
| 4,763,639 | A | 8/1988 | Goldsworthy | |
| 4,969,449 | A | 11/1990 | Levin | |
| 5,399,439 | A | 3/1995 | Rasmussen | |
| 5,447,097 | A * | 9/1995 | Rhee | 99/450 |
| 5,586,491 | A * | 12/1996 | Diller et al. | 99/450 |
| 5,605,143 | A * | 2/1997 | Hebert et al. | 126/41 R |
| 5,654,075 | A | 8/1997 | Ramirez | |
| 7,104,187 | B1 | 9/2006 | Robinson | |
| 2002/0023548 | A1 | 2/2002 | Almeida | |
| 2006/0130672 | A1 * | 6/2006 | Poulsen et al. | 99/422 |
| 2006/0143920 | A1 | 7/2006 | Morrison et al. | |
| 2007/0295224 | A1 * | 12/2007 | Glynn | 99/450 |

* cited by examiner

*Primary Examiner* — Reginald L Alexander
(74) *Attorney, Agent, or Firm* — Richard L. Miller

(57) ABSTRACT

Forming a perforated sheet which comprises a foil component and at least one flexible non-stick coating applied onto a surface of the foil component, wherein a plurality of apertures are then punched through the foil component and the at least one flexible non-stick coating to create a set of colored sequins and confetti with different colors on opposite surfaces.

6 Claims, 2 Drawing Sheets

Fig. 1
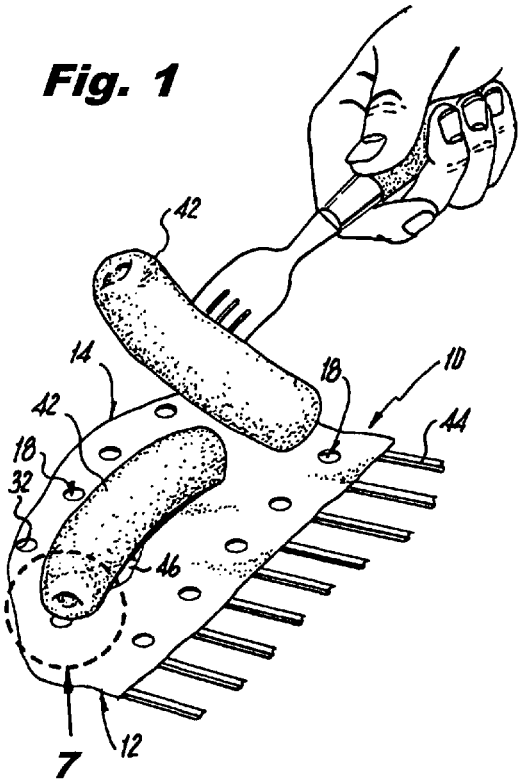
Fig. 2
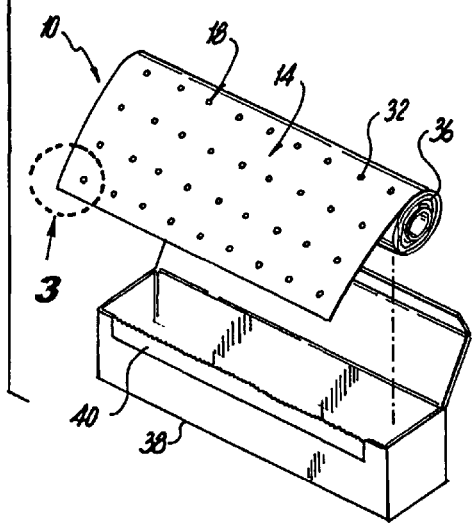
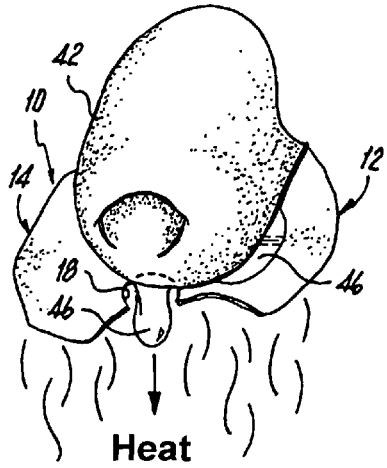
Fig. 7
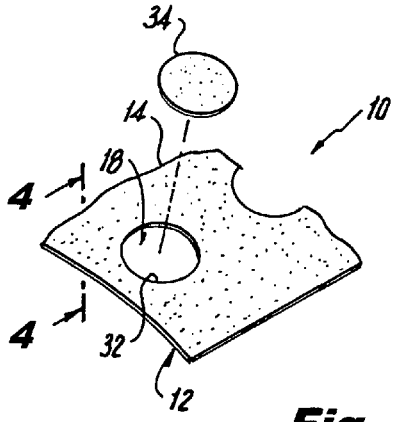
Fig. 3

PERFORATED SHEET MATERIAL AND A SET OF SEQUIN/CONFETTI

BACKGROUND OF THE INVENTION

1. Field of the Invention

The present invention relates to a sheet, and more particularly, a perforated sheet material and by product sequin/confetti punched out component created during the forming of the sheet.

2. Description of the Prior Art

Numerous innovations for barbecue grill surfaces have been provided in the prior art that will be described. Even though these innovations may be suitable for the specific individual purposes to which they address, however, they differ from the present invention.

A FIRST EXAMPLE, U.S. Patent Office Document No. 3,555,994, Issued on Jan. 19, 1971, to Nemetz et al. teaches a disposable drippings-shedding cover for the grill of a barbecue, formed to fit over and removably connect with the food-supporting wires thereof and so conforming to the wires as to provide for ample broiling heat for items of food disposed thereupon while also keeping drippings from the food reaching most of the wires of the grill.

A SECOND EXAMPLE, U.S. Patent Office Document No. 4,763,639, Issued on Aug. 16, 1988, to Goldsworthy teaches a disposable cover for covering the cooking surface of an outdoor charcoal fueled barbecue grill and directing the quantity and flow of air beneath the cover when it is placed onto the cooking surface of the grill. The cover is made from a manually formable material having a plurality of perforations arranged in rows, the perforations of each of the rows being in staggered radial relationship with the perforations of adjacent rows. The outward facing side of the cover has a highly polished shiny reflective metallic finish for reducing the radiant heat transfer from the grill and the inwardly facing surface has a coating of aromatic wood chips and a bonding agent for enhancing the flavor of food cooked on the grill.

A THIRD EXAMPLE, U.S. Patent Office Document No. 4,969,449, Issued on Nov. 13, 1990, to Levin teaches a disposable foil grill which consists of a corrugated and perforated sheet of heavy duty aluminum foil. The corrugations allow smoke to access virtually the entire bottom surface of the food being cooked so that the desired barbecue flavor is obtained. Fat from meat being cooked drips into troughs formed by the corrugation and exits through holes in the troughs onto the coals for generation of the smoke and flame which give food a desirable barbecue flavor. Another advantage of the disclosed disposable grill cover is that the distances between adjacent troughs may be changed by a slight pull on the ends of the foils to perfectly align the troughs with the spacings between the wire grating of the grill. In this way, holes formed in the bottom of the troughs for fat drippings do not allow the drippings to come in contact with the wire grating.

A FOURTH EXAMPLE, U.S. Patent Office Document No. 5,399,439, Issued on Mar. 21, 1995, to Rasmussen teaches a foil web that is arranged for positioning over a barbecue grill structure to effect the dissipation of grease and the like to drip uniformly to underlying briquettes and meter such grease in a manner to effect its dissipation and vaporization upon contact with an underlying heating structure. The web includes a matrix of apertures coextensive with the web of specific sizing to effect such dissipation.

A FIFTH EXAMPLE, U.S. Patent Office Document No. 5,586,491, Issued on Dec. 24, 1996, to Diller et al. teaches a disposable flexible foil product placed on a barbecue grill comprises a sheet of metal foil with rectangular vents. The pattern consists of two sets of vents equally offset from the center with a space in the middle. The pattern is repeated longitudinally with a central divider between patterns. The foil has a flat bottom surface. The foil is dispensable either from a roll or it is packaged in flat sheets or pans, having a scored line spaced in from the edge to allow for manual upturning of the edges.

A SIXTH EXAMPLE, U.S. Patent Office Document No. 5,654,075, Issued on Aug. 15, 1997, to Ramirez teaches a food preparation foil including a metal foil layer having a first flexible non-stick coating created on the metal foil layer and having channel folds running the width thereof that are oriented in parallel and spaced at intervals of about one and one-half (1½") inch. Each channel fold includes a number of steam release apertures formed therethrough.

A SEVENTH EXAMPLE, U.S. Patent Application Publication No. 20020023548 A1, Published on Feb. 28, 2002, to Almeida teaches a holey foil that comprises a sheet of aluminum foil presenting multiple small perforations distributed throughout most of the surface, cut to standardized sizes and enclosed in a package or provided in a roll for easy dispensing.

AN EIGHTH EXAMPLE, U.S. Patent Application Publication No. 20060143920 A1, Published on Jul. 6, 2006, to Morrison et al. teaches anodized aluminum foil sheets and expanded aluminum foil (EAF) and composites containing the same. Methods of making anodized aluminum foil sheets and expanded aluminum foil (EAF) and composites containing the same are also disclosed. Methods of using anodized aluminum foil sheets and expanded aluminum foil (EAF) and composites containing the same are further disclosed.

A NINTH EXAMPLE, U.S. Patent Office Document No. 7,104,187, Issued on Sep. 12, 2006, to Robinson teaches disposable electric cooking grill liners for protecting an electric cooking grill having a heated grilling surface of each of the pivotally connected moveable and stationary grilling members. Each grilling surface is heated and has raised cooking ribs wherein both sides of food placed between the closed grilling surfaces are simultaneously heated. Each grill liner is formed of a sheet of semi-rigid or heavy heat conductive foil preformed for fitting directly against and substantially conforming to and covering the corresponding grilling surface whereby cooking heat provided to each grilling surface is substantially transferred through the grilling liner without substantial food and juices flowing therefrom coming in contact with the grilling surfaces. Each grill liner also has a rigidized or stiffened margin for maintaining the preformed shape during installation, use and removal of each said grill liner after use. A juice collector and releasable attaching tabs for securement of the upper grill liner are also provided.

It is apparent now that numerous innovations for barbecue grill surfaces have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a perforated sheet that avoids the disadvantages of the prior art.

ANOTHER OBJECT of the present invention is to provide a perforated sheet that is simple and inexpensive to manufacture.

STILL ANOTHER OBJECT of the present invention is to provide a perforated sheet that is simple to use.

BRIEFLY STATED, STILL YET ANOTHER OBJECT of the present invention is to provide a perforated sheet which comprises a foil component and at least one flexible non-stick coating applied onto a surface of the foil component, wherein a plurality of apertures are then punched through the foil component and the at least one flexible non-stick coating.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 1 is a diagrammatic perspective view showing an embodiment of the present invention in use;

FIG. 2 is a diagrammatic perspective view showing the present invention in a roll ready to be inserted into a dispenser carton;

FIG. 3 is an enlarged perspective view of a portion of the present invention taken in the area enclosed by the dotted circle indicated by arrow 3 in FIG. 2;

FIG. 7 is an enlarged diagrammatic perspective view taken in the area enclosed by the dotted circle indicated by arrow 7 in FIG. 1.

A MARSHALING OF REFERENCE NUMERALS UTILIZED IN THE DRAWING

Figure 4:
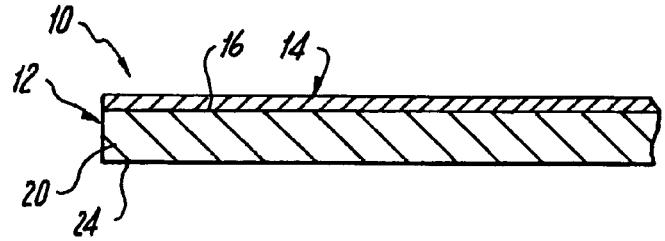
FIG. 4 is an enlarged diagrammatic cross sectional view, taken on line 4-4 in FIG. 3, showing the present invention with a non-stick coating on one side thereof.

| | |
|---|---|
| 10 | perforated sheet |
| 12 | foil component of perforated sheet |
| 14 | first flexible non-stick coating of perforated sheet 10 |
| 16 | first surface of foil component 12 |
| 18 | aperture in perforated sheet 10 |
| 20 | thin flexible metal material of foil component 12 |
| 22 | second flexible non-stick coating of perforated sheet 10 |
| 24 | second surface of foil component 12 |
| 26 | double layer for first flexible non-stick coating 14 and second flexible non-stick coating 22 |
| 28 | inner stratum of double layer 26 |
| 30 | outer stratum of double layer 26 |
| 32 | hole for aperture 18 |
| 34 | circular sequin/confetti punched from aperture hole 32 |
| 34A | square sequin/confetti punched from aperture hole 32 |
| 34B | hexagon sequin/confetti punched from aperture hole 32 |
| 34C | octagon sequin/confetti punched from aperture hole 32 |
| 34n | star sequin/confetti punched from aperture hole 32 |
| 36 | roll of perforated sheet 10 |
| 38 | dispenser carton for roll 36 |

-continued

| | |
|---|---|
| 40 | cutting blade on dispenser carton 38 |
| 42 | hot dog |
| 44 | barbecue grill |
| 46 | fat/grease |

DETAILED DESCRIPTION OF THE PREFERRED EMBODIMENT

Figure 5:
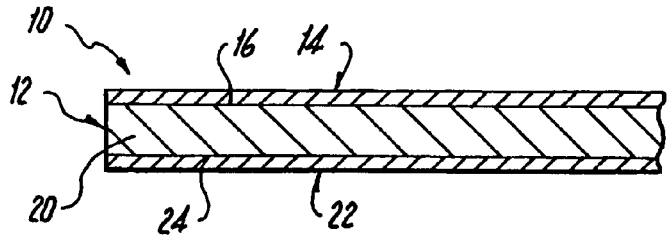
FIG. 5 is an enlarged diagrammatic cross sectional view similar to FIG. 4, showing the present invention with a non-stick coating on both sides thereof.

Referring now to the figures, in which like numerals indicate like parts, and particularly to FIGS. 1 through 7, which are a diagrammatic perspective view showing an embodiment of the present invention in use; a diagrammatic perspective view showing the present invention in a roll ready to be inserted into a dispenser carton; an enlarged perspective view of a portion of the present invention taken in the area enclosed by the dotted circle indicated by arrow 3 in FIG. 2; an enlarged diagrammatic cross sectional view, taken on line 4-4 in FIG. 3, showing the present invention with a non-stick coating on one side thereof; an enlarged diagrammatic cross sectional view similar to FIG. 4, showing the present invention with a non-stick coating on both sides thereof; an enlarged diagrammatic cross sectional view similar to FIG. 5, showing the present invention with a double non-stick coating on both sides thereof; and an enlarged diagrammatic perspective view taken in the area enclosed by the dotted circle indicated by arrow 7 in FIG. 1, and as such, will be discussed with reference thereto.

The present invention is a perforated sheet 10 which comprises a foil component 12 and at least one flexible non-stick coating 14 applied onto a surface 16 of the foil component 12, wherein a plurality of apertures 18 are then punched through the foil component 12 and the at least one 26 flexible non-stick coating 14.

The foil component 12 is comprised out of a thin flexible metal material 20. The thin flexible metal material 20 is selected from the group consisting of aluminum, copper, stainless steel, silver and gold. The flexible non-stick coating 14 is formed by anodizing the surface 16 of the thin flexible metal material 20.

As best seen in FIG. 5, the perforated sheet 10 can further comprise a second flexible non-stick coating 22 applied onto a second surface 24 of the foil component 12, wherein the plurality of apertures 18 are then punched through the first flexible non-stick coating 14, the foil component 12 and the second flexible non-stick coating 20. The first flexible non-stick coating 14 and the second flexible non-stick coating 22 are both formed by anodizing the first surface 16 and the second surface 24 of the foil component 12.

Figure 6:
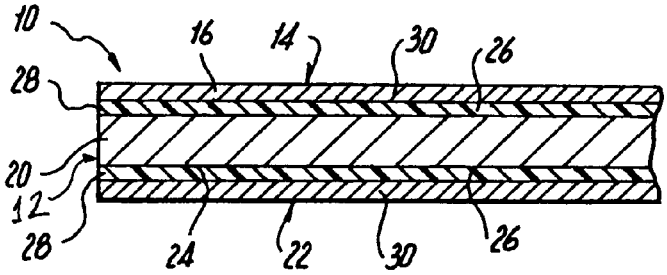
FIG. 6 is an enlarged diagrammatic cross sectional view similar to FIG. 5, showing the present invention with a double non-stick coating on both sides thereof.

As best seen in FIG. 6, the first flexible non-stick coating 14 can have a double layer 26 and the second flexible non-stick coating 22 can also have the double layer 26. Each double layer 26 comprises an inner stratum 28 being of a clear material and an outer stratum 30 being dyed a specific color. The first color in the outer stratum 30 of the first double layer 26 of the first flexible non-stick coating 14 can be a different color then the second color in the outer stratum 30 of the second double layer 26 of the second flexible non-stick coating 22.

Figure 8:
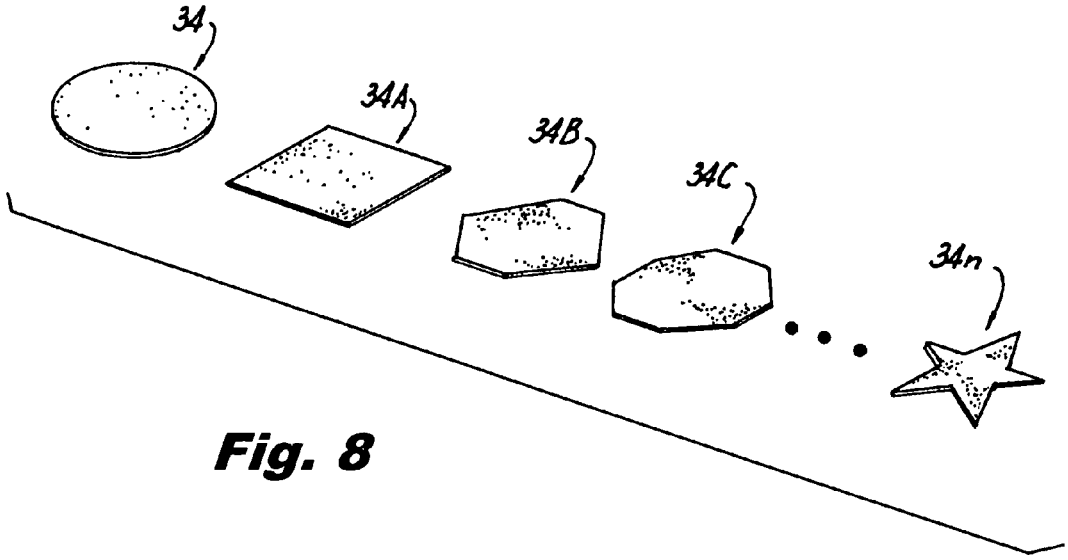
FIG. 8 illustrates that there are an infinite variety sequin/confetti punched disked

The perforated sheet 10 comprises a thickness ranging from about 0.001 inch to about 0.015 inch. Each aperture 18 in the perforated sheet 10 is a hole 32 having a diameter ranging from about 1/16 inch to about 3/8 inch. As shown in FIGS. 3 and 8, each punched out disc piece 24 from each hole 32 is a decorative item that can be utilized as a sequin/confetti or placed upon a flat surface, such as a wall.

As shown in FIG. 2, the perforated sheet 10 is of an elongated length and rolled up into a roll 36. A dispenser carton 38 is provided having a cutting blade 40 thereon. The roll 36 of the perforated sheet 10 is carried within the dispenser carton 38 to be dispensed therefrom by the cutting blade 40 when needed.

A process for forming the perforated sheet 10 comprises the steps of:

1. Producing the foil component 12;
2. Anodizing the foil component 12; and
3. Punching the anodized foil component 12 with a plurality of apertures 18 therethrough. It is to be noted that it imperative that if the foil is to have different colors on opposite surfaces that it be punched after anodizing so that chemical processing fluids from opposite surfaces do not mix with each other. It is to be further noted that the apertures may be formed in an infinite variety of shapes, typically but not limited to circles, ovals, polygons stars etcetera for which just a small number have been illustrated in FIG. 8. The last disc piece sequin/confetti illustrated in FIG. 8, punched from aperture hole 32 is accordingly numbered 34*n* to imply the selection of shapes is truly infinite. It is also to be noted that all the apertures formed in a sheet need not all be of the same shape.

FIGS. 1 and 7 show the perforated sheet 10 cooking hot dogs 42 on a barbecue grill 44. The apertures 18 will control the amount of fat and grease 46 dripping into the barbecue grill 44, thereby reducing flare-ups. The flexible non-stick coating 14 will shield the hot dogs 42 and prevent them from sticking thereto.

The perforated sheet 10 can also be utilized for other types of cooking, such as covering a frying pan to reduce splattering of grease and sauce. The perforated sheet 10 can also be used in an oven.

The perforated sheet 10 when dyed colors can also be a decorative item when mounted upon a wall or the like. The disc pieces 34 when attached to clothing can become sequins.

It will be understood that each of the elements described above, or two or more together, may also find a useful application in other types of constructions differing from the types described above.

While the invention has been illustrated and described as embodiments of a perforated sheet, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A perforated sheet which comprises:

a) a foil component;

b) a first flexible non-stick coating disposed on a first surface of said foil component; and c) a second flexible non-stick coating disposed on a second surface of said foil component;

wherein said second surface of said foil component is opposite to said first surface of said foil component so as to allow said second surface of said foil component to be separate and distinct from said first surface of said foil component so as to allow said first flexible non-stick coating and said second flexible non-stick coating to be disposed on opposite sides of said foil component, respectively;

wherein said first flexible non-stick coating and said second flexible non-stick coating are both oxide coats;

wherein said first flexible non-stick coating has a double layer;

wherein said second flexible non-stick coating has a double layer; and wherein said first flexible non-stick coating, said foil component, and said second flexible non-stick coating have a plurality of apertures therethrough.

2. The perforated sheet as recited in claim 1, wherein said foil component is comprised out of a thin flexible metal material.

3. The perforated sheet as recited in claim 2, wherein said thin flexible metal material is selected from the group consisting of aluminum, copper, stainless steel, silver and gold.

4. The perforated sheet as recited in claim 1, wherein each said double layer comprises:

a) an inner stratum being of a clear material; and b) an outer stratum being dyed a specific color.

5. The perforated sheet as recited in claim 4, wherein said first color in said outer stratum of said first double layer of said first flexible non-stick coating is of a different color then said second color in said outer stratum of said second double layer of said second flexible non-stick coating.

6. The perforated sheet as recited in claim 1, wherein said perforated sheet comprises a thickness ranging from about 0.001 inch to about 0.015 inch.

* * * * *